US011320153B2

(12) United States Patent
Clements et al.

(10) Patent No.: US 11,320,153 B2
(45) Date of Patent: May 3, 2022

(54) SYSTEM AND METHOD FOR SELECTIVELY COVERING AN APPLIANCE

(71) Applicant: Viking Range, LLC, Greenwood, MS (US)

(72) Inventors: Samuel Kirk Clements, Grenada, MS (US); Martin D. Makowsky, Greenwood, MS (US); Roger Noles, Carrollton, MS (US); Wing Tun Chow, Greenwood, MS (US); Edward Thomas Lucic, Greenwood, MS (US)

(73) Assignee: VIKING RANGE, LLC, Greenwood, MS (US)

( * ) Notice: Subject to any disclaimer, the term of this patent is extended or adjusted under 35 U.S.C. 154(b) by 376 days.

(21) Appl. No.: 16/212,261

(22) Filed: Dec. 6, 2018

(65) Prior Publication Data

US 2019/0178504 A1 Jun. 13, 2019

Related U.S. Application Data

(60) Provisional application No. 62/597,795, filed on Dec. 12, 2017.

(51) Int. Cl.
*F24C 15/30* (2006.01)
*F24C 15/02* (2006.01)
(Continued)

(52) U.S. Cl.
CPC ..... *F24C 15/30* (2013.01); *A47B 77/08* (2013.01); *E05F 15/40* (2015.01); *F24C 3/12* (2013.01);
(Continued)

(58) Field of Classification Search
CPC .... F24C 3/12; F24C 5/16; F24C 7/082; F24C 15/022; F24C 15/026; F24C 15/30; A47B 77/08; E05F 15/40
(Continued)

(56) References Cited

U.S. PATENT DOCUMENTS 5,657,743 A 8/1997 Schwarzbacker et al.
7,234,457 B2 6/2007 Bartmann et al.
(Continued)

FOREIGN PATENT DOCUMENTS

CN 2824685 Y 10/2006
CN 201977603 U 9/2011
(Continued)

OTHER PUBLICATIONS

Internet Discussion Post, "Door the doors open and then slide down the side? Where did you find these? Exactly what I am looking for for," Houzz, Published Mar. 27, 2013, Available at < https://www.houzz.com/discussions/414195/door-the-doors-open-and-then-slide-down-the-side-where-did-you-find-these-exactly-what-i-am-looking-for-for>, 1 page.
(Continued)

*Primary Examiner* — James O Hansen
(74) *Attorney, Agent, or Firm* — Crowell & Moring LLP; John C. Freeman

(57) ABSTRACT

A system for selectively enclosing an appliance is provided. The system includes a first device and a second device. The first device detects whether a first door is in a fully open configuration. When the first door is in the fully open configuration, the first device sets the appliance into an operational mode. When the first door is not in the fully open configuration, the first device sets the appliance into a limited mode. The second device includes a locking device and detects whether the appliance is in a working mode. When the appliance is in the working mode, the second device engages the locking device to prevent a motion of the first door away from the fully open configuration. When the appliance is not in the working mode, the second device disengages the locking device to allow the motion of the first door.

18 Claims, 19 Drawing Sheets

(51) Int. Cl.

| | |
|---|---|
| ***F24C 7/08*** | (2006.01) |
| ***A47B 77/08*** | (2006.01) |
| ***F24C 3/12*** | (2006.01) |
| ***F24C 5/16*** | (2006.01) |
| ***E05F 15/40*** | (2015.01) |

(52) U.S. Cl.
CPC ..... *F24C 5/16* (2013.01); *F24C 7/082* (2013.01); *F24C 15/022* (2013.01); *F24C 15/026* (2013.01)

(58) Field of Classification Search
USPC ..... 312/139.1, 409; 126/190, 197; 219/391
See application file for complete search history.

(56) References Cited

U.S. PATENT DOCUMENTS

| | | | | |
|---|---|---|---|---|
| 7,255,101 | B2 | 8/2007 | Grutzke et al. | |
| 7,735,480 | B2 | 6/2010 | Larsen et al. | |
| 8,047,198 | B2 * | 11/2011 | Meyer | F24C 15/023 126/190 |
| 8,226,180 | B2 | 7/2012 | Patil et al. | |
| 8,327,835 | B2 | 12/2012 | Larsen et al. | |
| 8,336,535 | B2 | 12/2012 | Larsen et al. | |
| 8,510,991 | B2 | 8/2013 | Collene | |
| 8,689,781 | B1 | 4/2014 | Chilton et al. | |
| 8,905,014 | B2 | 12/2014 | Shaffer | |
| 9,243,807 | B2 | 1/2016 | Chilton et al. | |
| 9,255,437 | B2 | 2/2016 | Kershner et al. | |
| 9,335,055 | B2 | 5/2016 | Chilton et al. | |
| 9,574,778 | B2 | 2/2017 | Woods et al. | |
| 2006/0096969 | A1 * | 5/2006 | Kim | F24C 7/082 219/394 |
| 2006/0289530 | A1 | 12/2006 | Cordae | |
| 2011/0284518 | A1 * | 11/2011 | Elston, III | F24C 7/087 219/391 |
| 2012/0180776 | A1 * | 7/2012 | Newsom | F24C 15/022 126/197 |
| 2013/0032132 | A1 | 2/2013 | Yantis | |
| 2017/0051922 | A1 | 2/2017 | Kaiser et al. | |

FOREIGN PATENT DOCUMENTS

| | | | |
|---|---|---|---|
| DE | 24 01 053 | A1 | 7/1975 |
| DE | 42 23 608 | A1 | 1/1994 |
| DE | 102 08 473 | B4 | 3/2010 |
| EP | 0 392 522 | A1 | 10/1990 |
| EP | 2 884 188 | A1 | 6/2015 |
| JP | H 06-341651 | A | 12/1994 |

OTHER PUBLICATIONS

Barry et al., "The Slide&Hide Oven Is Amazing. You Can't Have It." Reviewed.com, Published Apr. 14, 2014, Available at http://ovens.reviewed.com/news/neff-sells-the-coolest-oven-americans-have-never-heard-of, 2 pages.

* cited by examiner

SYSTEM AND METHOD FOR SELECTIVELY COVERING AN APPLIANCE

CROSS-REFERENCE TO RELATED APPLICATIONS

This application claims priority from U.S. Provisional Application No. 62/597,795, filed on Dec. 12, 2017, the entirety of which is hereby fully incorporated by reference herein.

TECHNICAL FIELD

The subject disclosure is directed to a system and method for selectively covering an appliance.

BACKGROUND

An appliance includes a piece of equipment designed to perform a task. The appliance may be used in a residential environment, for example, in a residential kitchen. The appliance may also be used in a commercial environment, for example, in a kitchen in a restaurant. When an appliance is not being used, the appliance is still in the sight of view, disrupting a seamless and integrated appeal to the surroundings. Currently, there is no system or method for selectively covering the appliance and providing a safe usage to the appliance, the surrounding environment, and the appliance's user.

BRIEF SUMMARY

The present disclosure describes a system for selectively covering an appliance. The system includes a first device coupled to a first door, and the first device is configured to detect whether the first door is in a fully open configuration. When it is detected that the first door is in the fully open configuration, the first device is configured to set the appliance into an operational mode so it is possible for the appliance to operate in a working mode. When it is detected that the first door is not in the fully open configuration, the first device is configured to set the appliance into a limited mode where it is not possible for the appliance to operate in the working mode. The system also includes a second device comprising a first locking device. The second device is coupled to the first door and the second device is configured to detect whether the appliance is in the working mode. When it is detected that the appliance is in the working mode, the second device is configured to engage the first locking device to prevent a motion of the first door away from the fully open configuration. When it is detected that the appliance is not in the working mode, the second device is configured to disengage the first locking device to allow the motion of the first door.

The present disclosure is directed to a method for selectively covering an appliance. The method includes a first device and a second device. The first device is configured to be coupled to a first door. The second device is configured to be coupled to the first door. The second device includes a locking device. The method includes detecting, by the first device, whether the first door is in a fully open configuration. When it is detected that the first door is in the fully open configuration, the method includes setting, by the first device, the appliance into an operational mode so that is possible to operate in a working mode. When it is detected that the first door is not in the fully open configuration, the method includes setting, by the first device, the appliance into a limited mode. The method further includes detecting, by the second device, whether the appliance is in the working mode. When it is detected that the appliance is in the working mode, the method includes engaging, by the second device, the locking device to prevent a sliding motion of the first door. When it is detected that the appliance is not in the working mode, the method includes disengaging, by the second device, the locking device to allow the sliding motion of the first door.

DETAILED DESCRIPTION

Figure 1A:
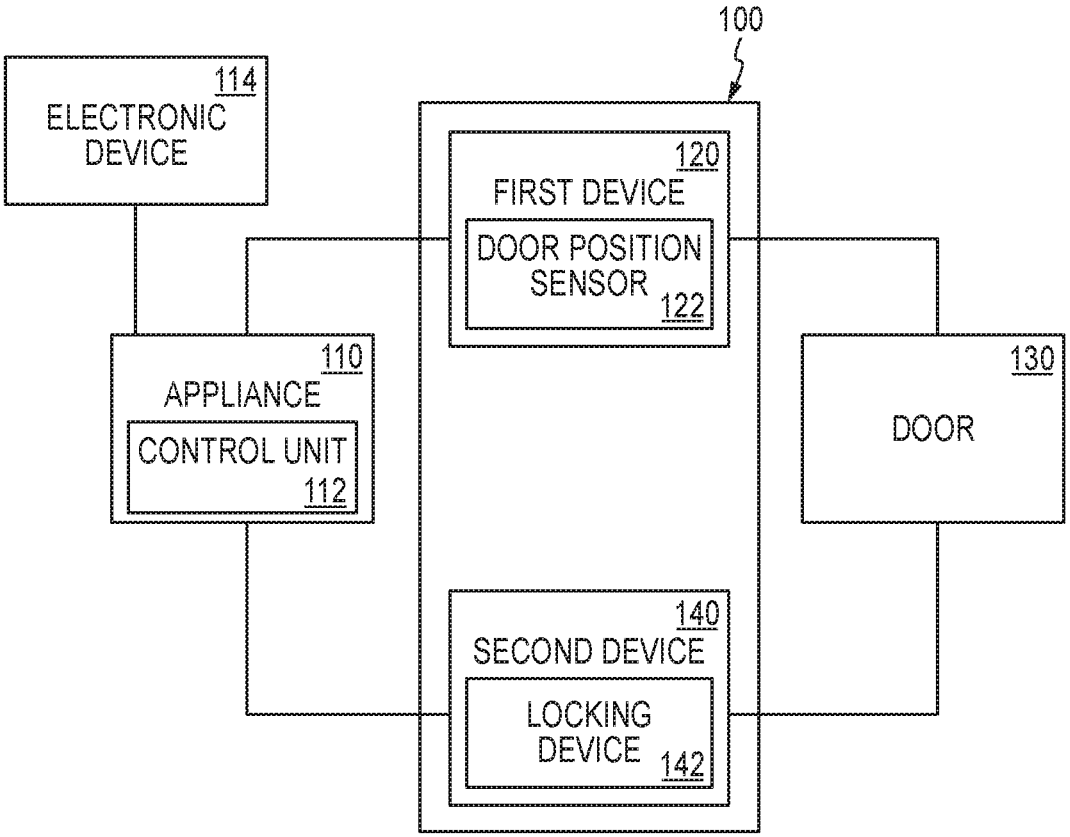
FIG. 1A is a block diagram of a system for selectively covering an appliance with a door.

The disclosure will now be described in detail hereinafter with reference to the accompanied drawings, which form a part of the present disclosure, and which show, by way of illustration, specific examples of embodiments. Please note that the disclosure may, however, be embodied in a variety of different forms and, therefore, the covered or claimed subject matter is intended to be construed as not being limited to any of the embodiments to be set forth below. Please also note that the disclosure may be embodied as methods, devices, components, or systems. Accordingly, embodiments of the disclosure may, for example, take the form of hardware, software, firmware or any combination thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter includes combinations of exemplary embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" or "at least one" as used herein, depending at least in part upon context, may be used to describe any feature, structure, or characteristic in a singular sense or may be used to describe combinations of features, structures or characteristics in a plural sense. Similarly, terms, such as "a", "an", or "the", again, may be understood to convey a singular usage or to convey a plural usage, depending at least in part upon context. In addition, the term "based on" or "determined by" may be understood as not necessarily intended to convey an exclusive set of factors and may, instead, allow for existence of additional factors not necessarily expressly described, again, depending at least in part on context.

The disclosure discloses a system and method for selectively covering an appliance. The appliance may be a residential appliance or a commercial appliance. The appliance may be refrigeration equipment, for example and not limited to, a freezer, a refrigerator, or a water cooler. The appliance also includes cooking equipment, for example and not limited to, a range, a stove, a wall oven, a cooking plate, or a microwave oven. The appliance may include washing and drying equipment, for example and not limited to, a dishwasher, a clothes washer, or a clothes dryer. The appliance may be air conditioner or the like. In some embodiments, where the appliance is cooking equipment, or washing and drying equipment, the appliance may include one or more electrical heating elements, and in some embodiments, the appliance may include one or more gas burners.

In FIG. 1A, a system 100 is provided to selectively cover an appliance with a door or more than one door 130. The door 130 may be made from a suitable material to cover the appliance, for example and not limited to, wood, plastic, polyethylene, steel, aluminum, or fiberglass. In some embodiments, the door may be made to match the structural and/or ornamental attributes of the components within the space, as shown schematically in FIG. 1C.

The system 100 includes a first device 120 and a second device 140. The first device is coupled to a door 130 and in communication with an appliance 110. The second device is also coupled to the door 130 and in communication with the appliance 110.

The appliance 110 may have an operational mode and a limited mode.

When the appliance is in the operational mode, the appliance can be operated as desired by a user, either manually or based upon a schedule and/or a recipe. For example, when the appliance is in the operational mode, a user can turn on the appliance, adjust/select the setting through a control panel of the appliance, turn off the appliance, and the like. The functional operation of the oven is considered the working mode.

When the appliance is in the limited mode, in some embodiments it is not possible for the appliance to operate in the working mode, or in some embodiments, it is not possible for the appliance to operate with all functionality of the working mode.

Figure 1B:
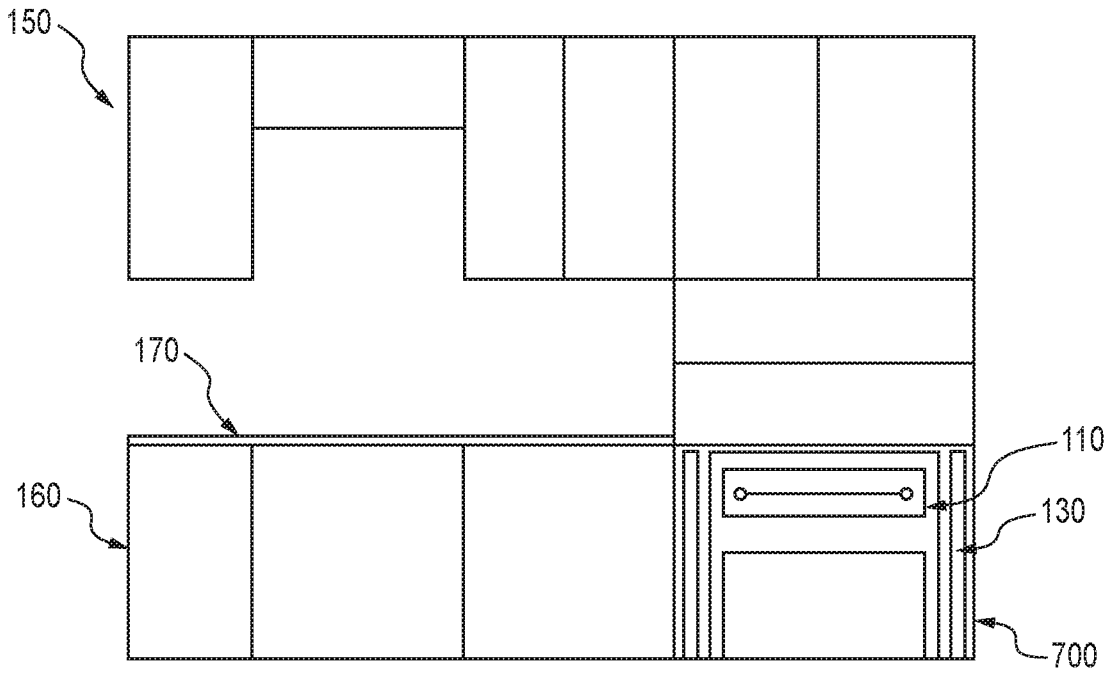
FIG. 1B is an illustration of a wall oven in a kitchen in one embodiment, with the door(s) in a fully open configuration.
Figure 1C:
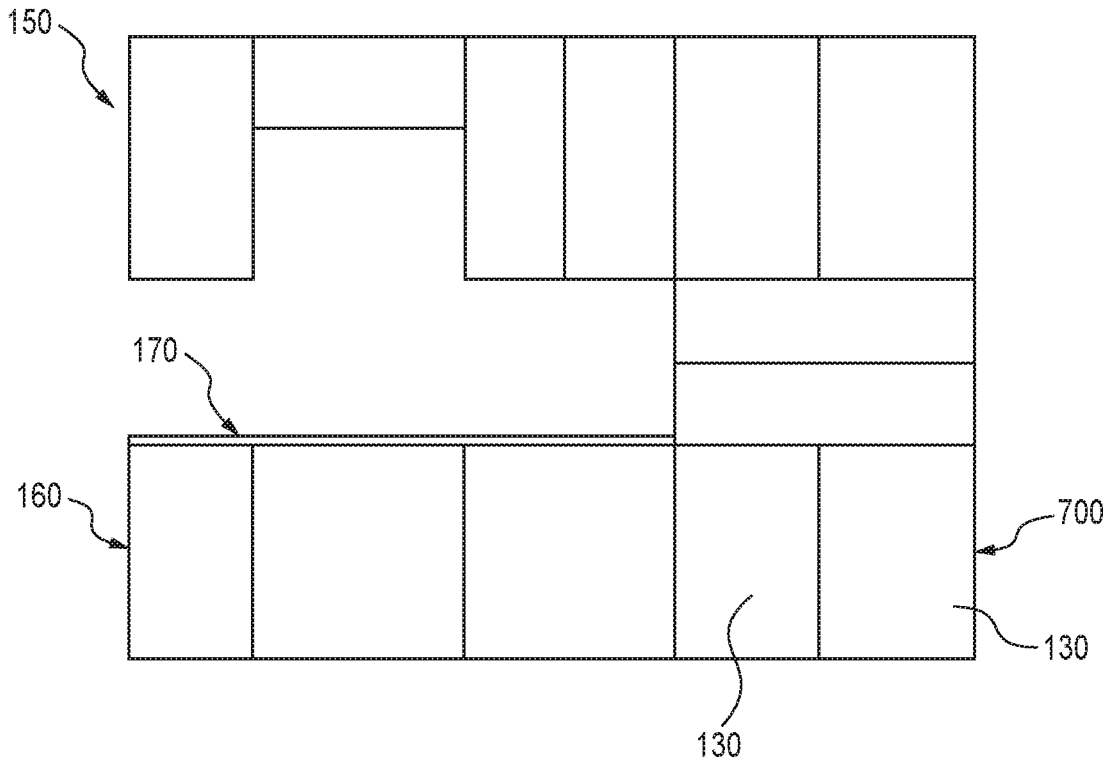
FIG. 1C is an illustration of the wall oven in FIG. 1B, with the doors in a fully closed configuration.

In one embodiment as in FIG. 1B, the appliance may be a wall oven 110 with one or more electrical heating elements. The wall oven 110 is disposed inside an oven compartment 700 or an enclosure in a kitchen. The compartment may be mounted in conjunction with other wall cabinets, base cabinets, and may be aligned as ergonomically and aesthetically desired with respect to countertops or other structures in a working space, such as a kitchen. In some embodiments, the doors 130 discussed herein, when closed may be positioned and may be designed to visually match the doors for neighboring cabinets, or other features of the kitchen, such that the doors partially or fully provide camouflage to the existence of the wall oven 110 behind the doors. As discussed herein, the doors 130 may be easily and quickly opened and stowed by the user (or in some embodiments automatically) to allow the user full functionality of the appliance when the doors are stowed.

While a wall oven 110 is discussed in detail herein, one of ordinary skill in the art with a thorough review of this specification and figures will comprehend how the disclosed aspects can be successfully implemented with other cooking equipment, or other types of appliances without undue experimentation. In some embodiments, the appliances may be selectively covered or exposed based upon the position of one or more doors with respect to the appliance, or the appliance's enclosure 116, with the potential use or operation of the appliance being automatically controlled based upon the position of the one or more doors with respect to the appliance or the enclosure.

The wall oven 110 may have one or more electric heating elements that may be controlled by the user via a control unit 112 disposed upon or fixed in conjunction with the wall oven 110. In some embodiments may be controlled remotely through an electronic device 114, such as via a computer, tablet, smartphone, or other remote device that can communicate, either wirelessly or through a wired connection, with the wall oven 110 (as shown schematically in FIG. 1A).

The wall oven 110 may have an operational mode where the wall oven is available to operate per its designed functionality (i.e. in the working mode of the oven). The wall oven 110 may also have a limited mode. When the wall oven is in the operational mode, the heating elements of the wall oven 110 are allowed to be, or capable of being, turned on and operated as appropriate for the desired cooking event within the oven. For example, in the operational mode, the oven's 110 heating elements can operate to maintain a desired temperature, such as via feedback control, or can be operated so to cause the oven cavity to reach and maintain various temperatures within the oven to follow a pre-programmed recipe.

When the wall oven 110 is in the limited mode, the heating elements may be prevented from operating, either mechanically or electrically, or in multiple ways. In some embodiments, in the limited mode, the heating elements may be prevented from operation regardless of any signal from the wall oven's controller, while in some embodiments, the oven's controller controls whether the wall oven 110 is in the operational mode or the limited mode. In some embodiments, in the limited mode, only the operation of the heating elements is prevented, but other operations of the oven may be allowed, such as the ability to operate timers, operate one or more fans or other air movement components, operate lights, communicate with external devices, and the like. In some embodiments, when the wall oven is in the limited mode, all power to the wall oven is cut off and therefore the wall oven is incapable of performing any activity.

For example, in some embodiments with electrical heating elements used to heat the oven cavity, one or more contacts may be provided in the electrical circuit that allows current to the heating elements, with one or more relays that are operated by the control unit 112 to cause the contacts to be open when the wall oven 110 is in the limited mode, and to be shut when the wall oven 110 is in the operational mode. In some embodiments, the contacts are normally open such that the contacts will be opened unless held shut by the control unit 112, such as in the event of loss of power by the control unit 112. In some embodiments schematically depicted in FIG. 1D, the contacts associated with the electrical heaters (and in some embodiments with electrical current to the entire oven) as described above are operated by relays 113 that are controlled by the control unit 112 in the first device and based upon the sensed position of the door 130, as discussed below, irrespective of the control unit 112 for the wall oven 110. In some embodiments, the control unit 112, or in some embodiments, the door position system, may allow or prevent current to the heating elements with solid state electrical components or circuit design as known in the art.

When the wall oven 110 is in a working mode, the heating elements of the wall oven are operated to maintain the temperature within the oven cavity at a desired temperature for a cooking event or recipe.

The door 130 is movable with respect to the wall oven 110. The door 130 can be movable between a position where the wall oven 110 and in some embodiments the front surface of the oven is completed covered (FIG. 1C), and a position where the wall oven (front surface thereof) is exposed (FIG. 1B). In some embodiments, the door 130 may be manually moved by the user, while in some embodiments the door may be automatically moved with a movement system as directed by the user. The door 130 may be selectively positioned with respect to the wall oven 110 to cover only a portion of the front side 119 of the wall oven 110 or completely cover the front side of the appliance. The door 130 may be moved so that it does not cover the front surface 212 (FIG. 2) of the appliance, such that at least a portion of the front side of the wall oven 110 is exposed. The door 130 may have a fully open configuration. When the door 130 is in the fully open configuration, the front surface 212 of the wall oven is fully exposed to the user, so that the user can, for example, open the oven door 118 to access the cooking compartment (not shown) of the wall oven 110, and to manipulate the control section 117 of the oven (FIG. 5C).

FIGS. 2 and 3A-3C depict the first device 120, which may be provided in the system, and its operation with respect to the door 130. In some embodiments, the first device 120 includes a door position sensor 122, which can detect whether the door is in the fully open configuration. In some embodiments, when it is detected that the door 130 is not in the fully open configuration, the first device 120 may prevent operation or full operation of the oven, by placing the oven in the limited mode. In one embodiment, when it is detected that the door is in the fully open configuration, the first device 120 allows the wall oven 110 to enter or remain in the operational mode to allow the wall oven 110 to operate as desired.

Figure 1D:
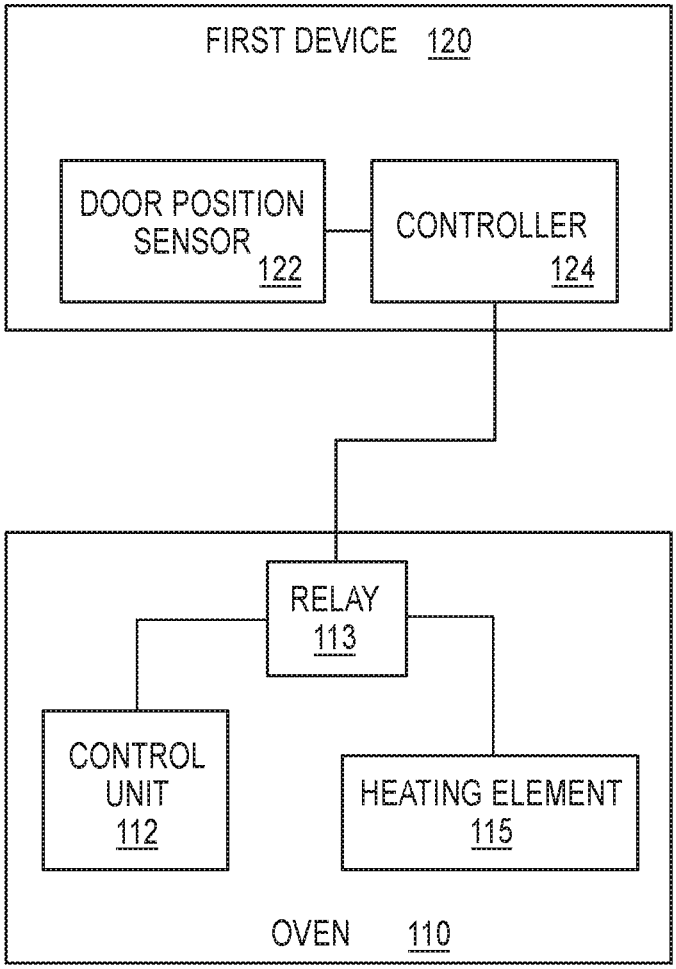
FIG. 1D is a block diagram of a first device in communication with a relay in a wall oven in one embodiment.

In FIG. 1D, when the door position sensor 122 detects that the door 130 is in the fully open configuration, a controller in the first device 120 may communicate with a relay 113 of the wall oven 110, to allow the heating element 115 to operate to produce heat within the oven cavity, or in some embodiments, the first device 120 may communicate with a control unit 112 to control the heating element or directly communicate with the heating element to allow the heating element to operate. When the door position sensor 122 detects that the door 130 is not in the fully open configuration, the first device 120 may communicate with the control unit 112 of the wall oven 110, to enter the limited mode, or to prevent operation of the heating element, or in some embodiments, the first device 120 may control a relay that operates contacts in electrical communication with the heating elements to either allow or prevent operation of the heating elements. Alternatively, the first device 120 may directly communicate with the heating element to prevent the heating element from operating.

In some embodiments as depicted in FIG. 1A, the system may include a second device 140 that is configured to detect whether the appliance is in the working mode, or in some embodiments, is configured to receive a signal from the appliance indicative of whether or not the appliance is in the working mode. In some embodiments, the second device 140 may be a locking device 142 that interacts with the door (directly or indirectly) to prevent the door 130 from moving with respect to the appliance. When the second device 140 detects that the appliance enters the working mode or is in the working mode, the second device may automatically engage the locking device 142 to prevent a motion of the door 130 away from the fully open position. When the second device 140 detects that the appliance is not in the working mode, the second device may automatically disengage the locking device 142 to allow the motion of the door 130 with respect to the appliance.

In some embodiments, the second device 140 may communicate with the control unit 112 of the appliance 110 to receive the current status of appliance to detect whether the appliance is in the working mode.

In some embodiments, the second device 140 may be configured to engage the locking device 142 when electrical power or communication to the second device is interrupted.

In one embodiment, the appliance may be a wall oven 110. When the second device 140 detects that the wall oven 110 begins to enter into the working mode or is in the working mode, the second device 140 may engage the locking device 142 to prevent a motion of the door 130 away from the fully open configuration. When the second device 140 detects that the wall oven 130 is not in the working mode, the second device 140 can disengage the locking device 142 to allow the motion of the door 130. In some embodiments, the second device 140 may receive information from the control unit 112 of the wall oven 110, for example and not limited to, status of heating elements of the wall oven, current oven temperature, and the like. For example, when the second device 140 receives information that one or more heating elements are energized or the current oven temperature is above a certain threshold, the second device 140 may detect that the wall oven 110 is in the working mode.

Figure 2:
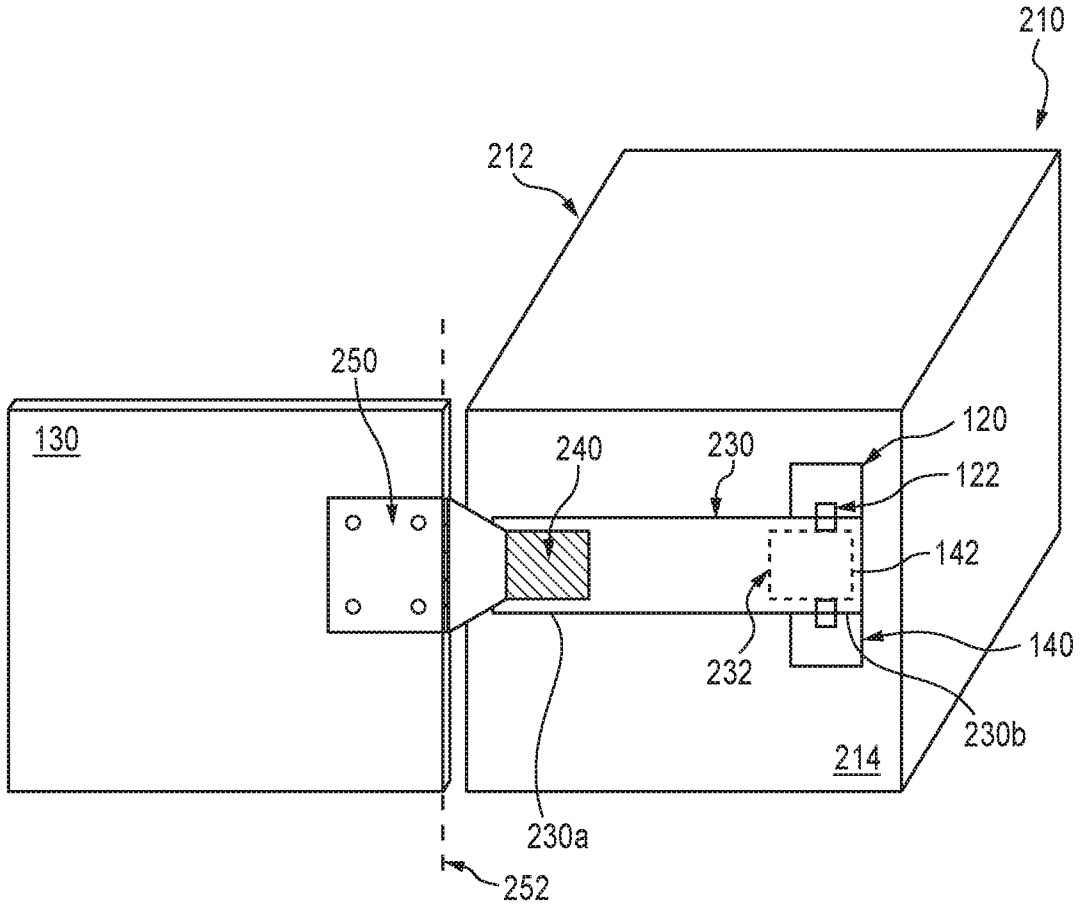
FIG. 2 is a schematic side view of a system in one embodiment for selectively covering an appliance with a door.

In one embodiment as in FIG. 2, an appliance, such as a wall oven 110 has a front side 212, which is normally accessed by the user to operate the wall oven 110. In some embodiments, one or more tracks 230 are fixed with respect to a side wall 214 of the wall oven 110 that is perpendicular to the front side 212 of the appliance. In some embodiments, the tracks 230 are fixed directly to the side walls of the oven 110. A sliding part 240 is configured to slide along the track 230 and support all or a portion of the door 130 to allow the door 130 to slide along the track 230. In other embodiments, the track 230 may be fixed to a side wall of an enclosure (such as the enclosure 700 depicted in FIGS. 7A, 7B below), which is provided to support the appliance, such as the wall oven 110. The enclosure 700 may have right and left walls 714, 716, a bottom wall 718, and a top wall (not shown but parallel and above the bottom wall and above the oven 110 in the perspective of FIGS. 7A and 7B). These structures of the enclosure define a receiving space 705 within which an appliance (such as a wall oven 110) may be received.

A hinge 250 may be fixed on the sliding part 240 and slidable together with the sliding part 240 along the track 230. The hinge 250 may support the door 120. The hinge may allow the door 130 to pivot along a pivoting axis 252 with respect to the track when the sliding part reaches an end portion of the track, opposite from the position on the track where the door is fully open. In some embodiments, the hinge 250 is prevented from pivoting until the sliding part 240 has reached the extended end 230*a* of the track 230.

In some embodiments as shown in FIG. 2, the first device 120 includes a door position sensor 122 and a second device 140 includes a locking device 142. When the door 120 is in the fully open configuration, the sliding part 240 is at a fully open position depicted at element number 232, and is at the inner end of the track 230. In this position the sliding part 240 interacts with the door position sensor 122, such that the door position sensor 122 identifies that the door is in the fully open position and in some embodiments communicates with the first device 120 and/or the control system 112 of the appliance When the door is in the fully open position, the sliding part 240 may be also coupled with the second device 140. When the second device detects or receives a signal indicative that the appliance is in the working mode, the locking device 142 of the second device engages the sliding part 240 to block the sliding part and the door 130 from sliding along the track 230 away from the fully open position 232.

In some embodiments, the track 230 may be long enough so that when the sliding part 240 is at the fully open position 232, the door completely slides into a compartment 590 enclosing the appliance, or in embodiments where a structural compartment 590 is not provided, the door 130 slides to a position where the outer edge of the door is recessed behind or in line with the front surface 212 of the appliance.

Figure 3A:
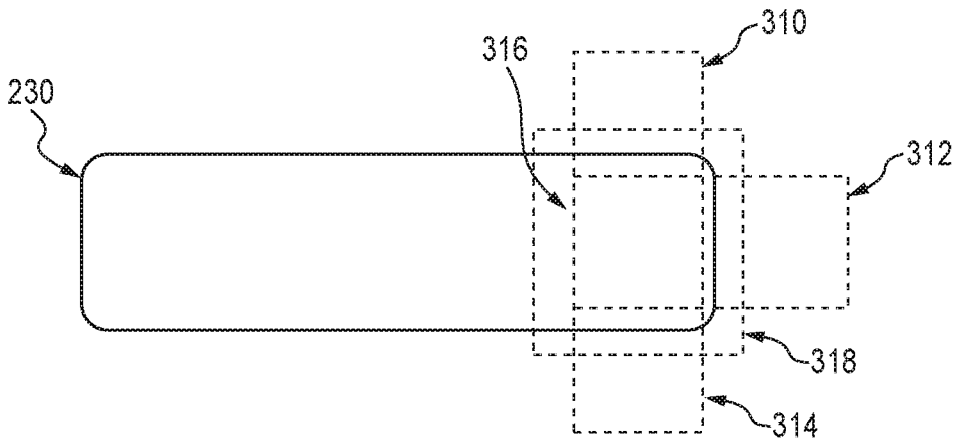
FIG. 3A is a schematic side view of potential locations of a first device or a second device relative to a track, that is usable, for example, with the first device of FIG. 2.
Figure 3B:
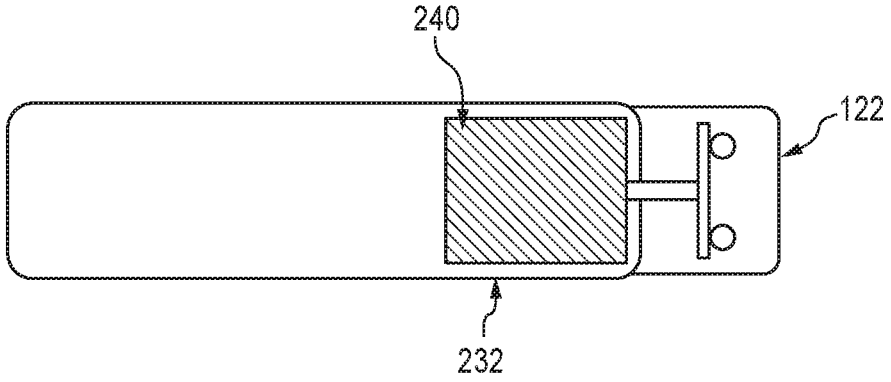
FIG. 3B is a schematic side view of a door position sensor in one embodiment, that is usable, for example, with the first device of FIG. 2.

In some embodiments as depicted in FIG. 3A, the first device 120 and the second device 140 may be placed at a top portion 310, a side portion 312, a bottom portion 314, a behind the track position 316, or an above the track position 318. The first device and second device may be together at the same side relative to the track or may be separately at different sides relative to the track.

The door position sensor 122 of the first device may be a sensor that is physically actuated, for example, a push button switch, a toggle switch, and a rocker switch based upon the position of the door 130 or the sliding part 240 upon the track 230. In one embodiment in FIG. 3B, a push button switch may be used. When the sliding part 240 slides to the fully open position 232, the sliding part physically pushes the push button switch and actuates the push button switch, so that it is detected that the door is in the fully open configuration.

The push button switch may be a normally open switch, i.e., a push button switch allowing electricity to flow between its two contacts when pressed. The push button switch may alternatively be a normally closed switch, i.e., a push button switch allowing electricity to flow between its two contacts when not pressed. The push button switch may also be other types of push button switches, or other types of detectors to perform the similar functions as described above.

Figure 3C:
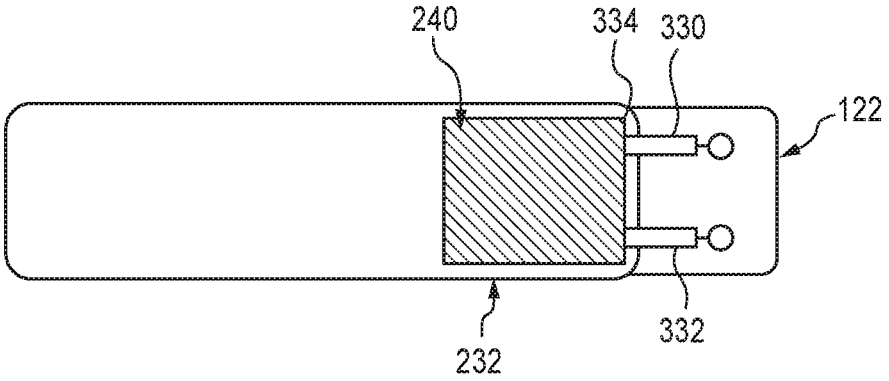
FIG. 3C is a schematic side view of another door position sensor in one embodiment that is usable, for example, with the first device of FIG. 2.

In some embodiments, the door position sensor 122 of the first device may be an electrically actuator sensor for example, electrical contacts shown in FIG. 3C. The two electrical contacts are insulated from the track and conduct no electricity when the door is not in the fully open configuration. When the door is in the fully open configuration and the sliding part is at the fully open position, the two electrical contacts make electrical contact with an electrically conductive side 334 of the sliding part 240 and conduct electricity. The door position sensor may also be other types of switches actuated electrically to perform the similar functions as described above.

In some embodiments, the door position sensor 122 may include magnets either on the door 130, the sliding part 240, or on a fixed sensor component that are either coupled or decoupled based upon the door position, with the coupling or decoupling of the magnets causing the door position sensor 122 to detect whether or not the door 130 is in the fully open position.

When the door position sensor detects that the door is in the fully open configuration, the first device may communicate with a control unit 112 of the appliance to allow the appliance into an operational mode. When the door position sensor does not detect that the door is in the fully open configuration, the first device can communicate with the control unit 112 of the appliance to set the appliance into a limited mode.

Figure 3D:
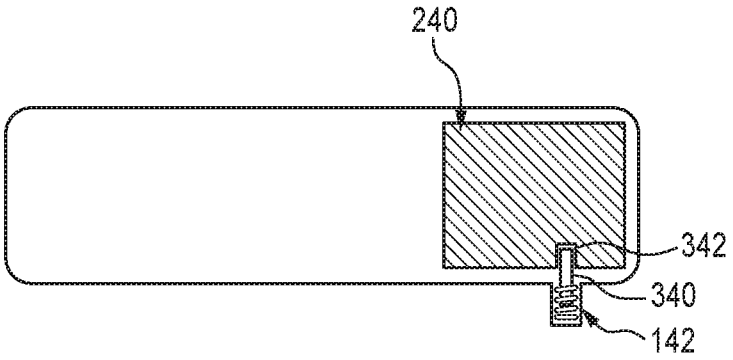
FIG. 3D is a schematic side view of a locking device in one embodiment, that is usable, for example, with the second device of FIG. 2.

As depicted in FIG. 3D, the locking device 142 of the second device may be a mechanical lock, for example, a lock including a solenoid controlled bar 340. When the second device detects the appliance is not in a working mode, the solenoid controlled bar is withdrawn away from engagement with the sliding part 240 so that the sliding part may slide away from the fully open position. When the second device detects the appliance enters the working mode or is in the working mode, the solenoid controlled bar extends to a position to engage a hole 342, recess, step, or other feature in the sliding part 240 so that the sliding part 240 is mechanically prevented from sliding away from the fully open position. In some embodiments, the locking device 142 may work with magnetic coupling with the door to prevent option of the door along the track. In some embodiments, the bar 340 may be manually or automatically overridden if actuated when the sliding part 240 is not in the fully open position to allow the sliding part 240 to return to the fully open position.

Figure 3E:
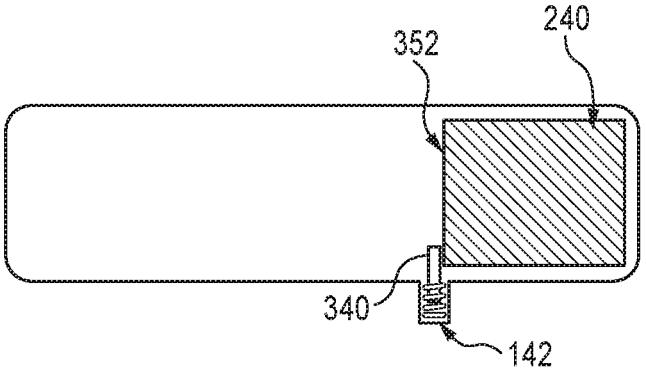
FIG. 3E is a schematic side view of a locking device in one embodiment, that is usable, for example, with the second device of FIG. 2.

In some embodiments in FIG. 3E, when the second device 140 detects or receives a signal that the appliance is in the working mode, the solenoid controlled bar 340 is extended outside the locking device to engage against a side 352 of the sliding part 240 so that the sliding part cannot slide away from the fully open position.

Figure 3F:
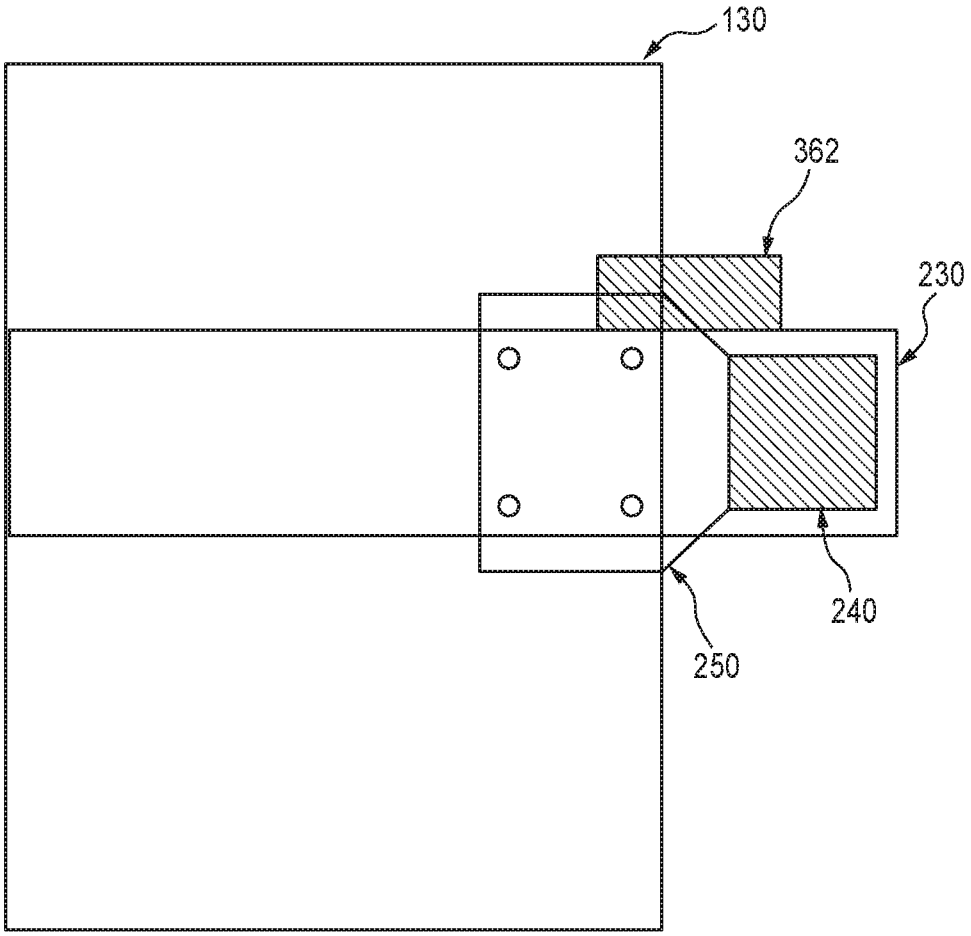
FIG. 3F is a schematic side view of a device in one embodiment to prevent the door from pivoting away from the orientation where the door is parallel to the track.

In some embodiments in FIG. 3F, the system may include another device 362 configured to limit the potential range of the motion of the door, such as preventing the door from pivoting away from an orientation where the door is parallel to the track 230. The device 362 may be fixed to either the side of the appliance or the track. The device 362 may include a slot. In operation, a portion of the door 130 or a portion of the hinge 250 supporting the door 130 may enter the slot and engage with the device 362, preventing the door from pivoting away from the orientation where the door is parallel to the track 230. In other embodiments, the device may include magnets. One magnet may be on the door 130, or a portion of the hinge 250 receiving the door. The other magnet may be on the track 230, or on the side of the appliance 214. Thus when the door is in the fully open configuration, the magnets are coupled with each other to prevent the door from pivoting away from the orientation where the door is parallel to the track 230.

Figure 3G:
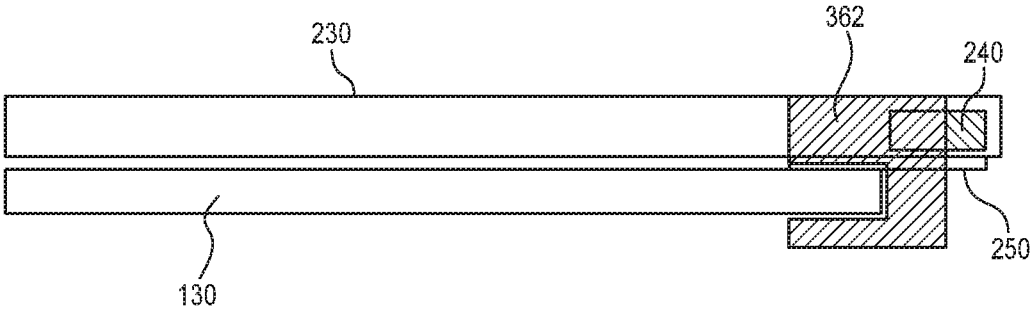
FIG. 3G is a schematic view of a device to prevent the door from pivoting to the closed position.

In some embodiments in FIG. 3G, a device 362 may be disposed close to the fully open position of the track 230 and fixed to the track 230. The device 362 have a slot to engage a portion of the door 130. When the door 130 is in fully open configuration, the portion of the door 130 can slide into the slot of the device 362 and be engaged with the device 362. When the door 130 is engaged with the device 362, the device 362 is configured to prevent the door 130 from pivoting away from the orientation where the door is parallel to the track 230.

Figure 4:
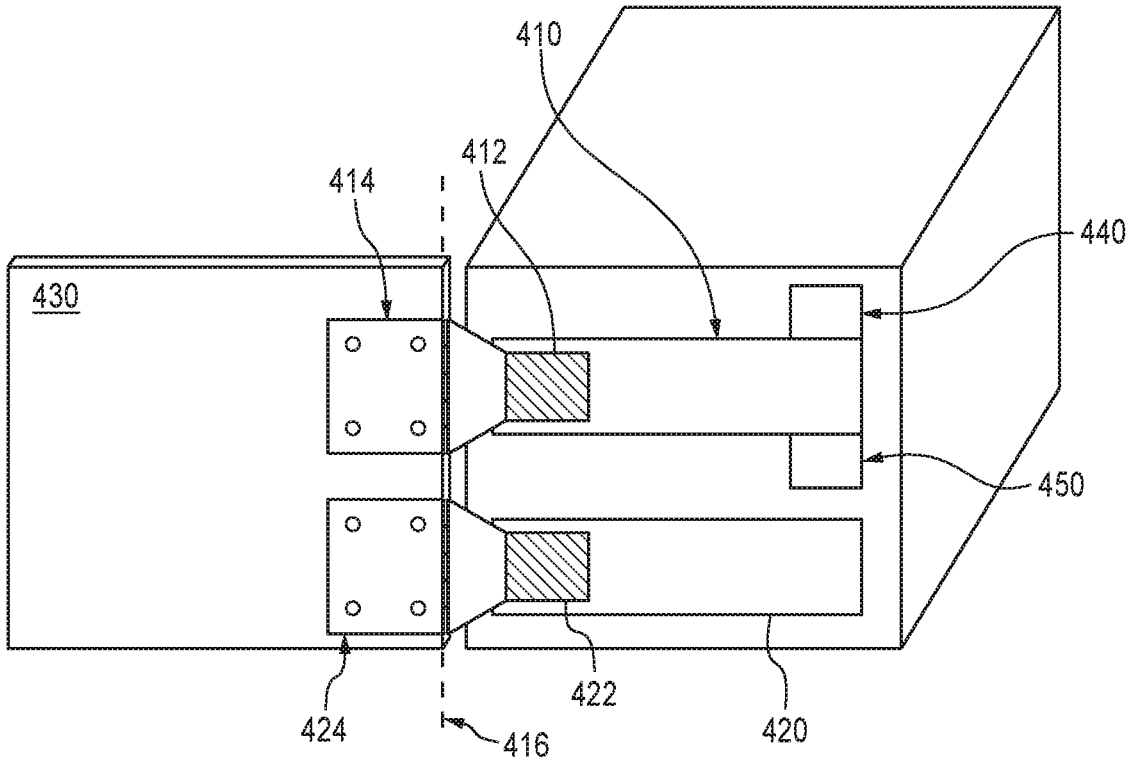
FIG. 4 is a schematic side view of a system in one embodiment with two tracks.

As depicted in FIG. 4, a first track 410 and a second track 420 are provided, which both support the door 130. In some embodiments, the first and second tracks 410, 420 may be like the track 240 discussed above. In some embodiments, additional tracks may also be provided. Each of the first and second tracks 410, 420 may be fixed with respect to the same side of the appliance and substantially parallel to each other. A first sliding part 412 is slidable along the first track, and a second sliding part 424 is slidable along the second track. A first hinge 414 is fixed on the first sliding part, and a second hinge 424 is fixed on the second sliding part. The first hinge 414 and the second hinge 424 together can receive a door 430, so that the door is pivotable with a pivoting motion of the first and second hinges 414, 424 along a pivoting axis 416.

In some embodiments where multiple tracks are provided, the first and second devices may be provided with respect to one of the tracks, both of the tracks, or the first device on the first track and the second device on the second track.

Figure 5A:
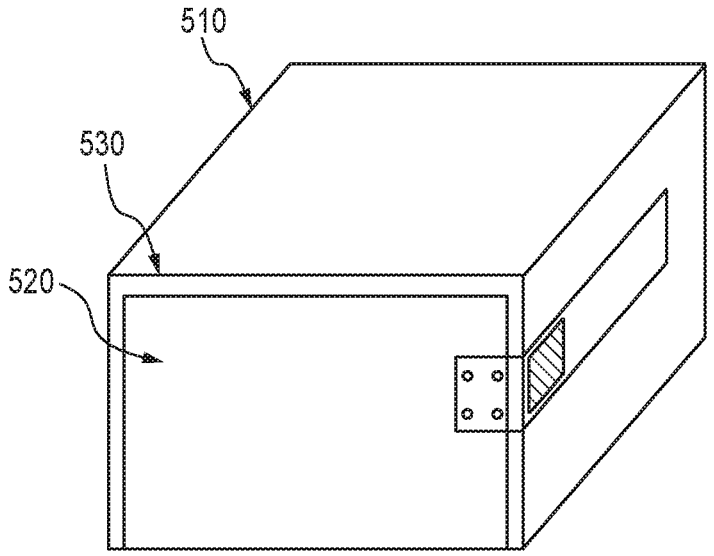
FIG. 5A is a schematic diagram of a system in one embodiment with one door, when the door is in a fully closed configuration.
Figure 5B:
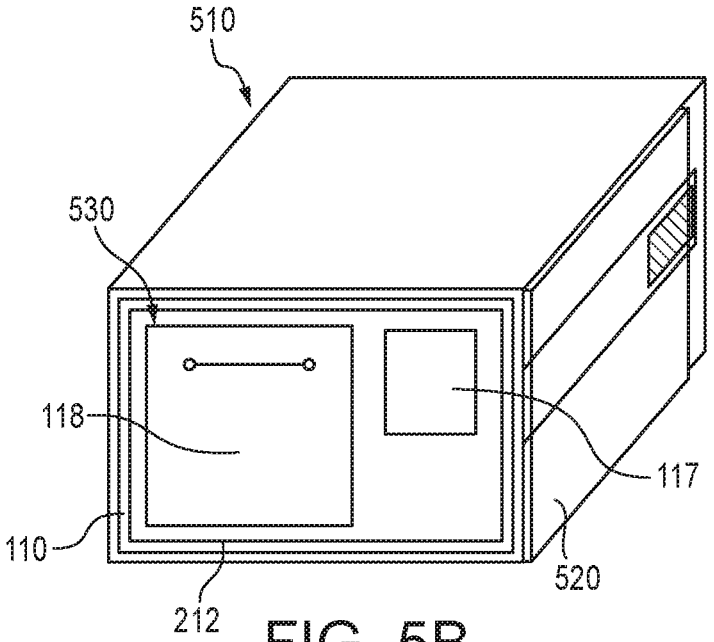
FIG. 5B is a schematic diagram of the system in FIG. 5A, when the door is in a fully open configuration.
Figure 5C:
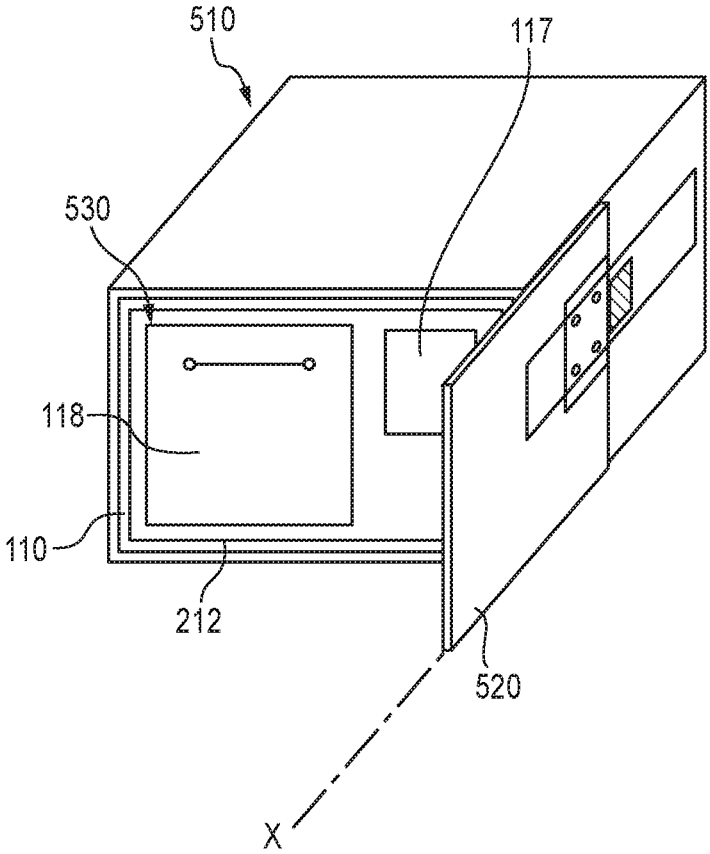
FIG. 5C is a schematic diagram of the system in FIG. 5A, when the door is in a position between the fully open configuration and the fully closed configuration.

In some embodiments and as depicted in FIG. 5A, a single door 520 may be provided to cover the entire front side of the appliance 510. The door 520 is at a fully closed configuration when the door 520 covers the front side of the appliance and the sliding part is at the fully closed position along its track. When a user desires to use the appliance, the user opens the door by pivoting the door, normally 90 or about 90 degrees, from the closed position (perpendicular or about perpendicular to the axis X of track 240 and then when the door is aligned along the longitudinal axis of the track 240 (depicted in FIG. 5C), the user pushes the door along the track 240 until the sliding part reaches the fully open position (depicted in FIG. 5B). The term "about" is specifically defined herein to include the reference value and means a range of values plus or minus 5 or 10% of the reference value.

Figure 5D:
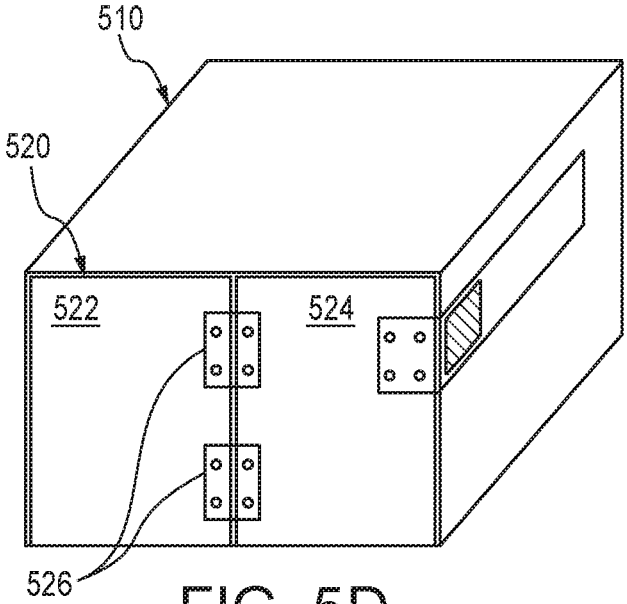
FIG. 5D is a schematic diagram of a system in one embodiment with two doors, when the doors are in a fully closed configuration.
Figure 5E:
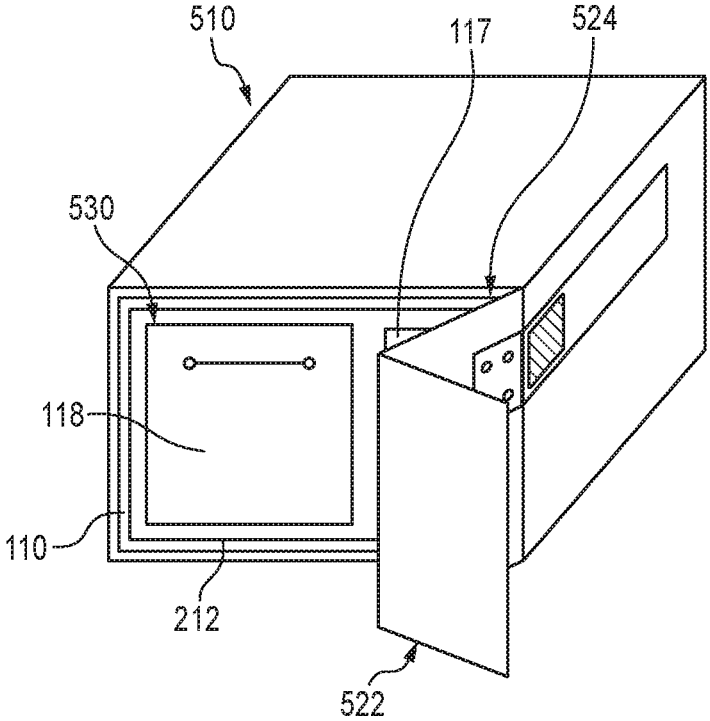
FIG. 5E is a schematic diagram of the system in FIG. 5D, when the doors are in a position between the fully closed configuration and a fully open configuration.
Figure 5F:
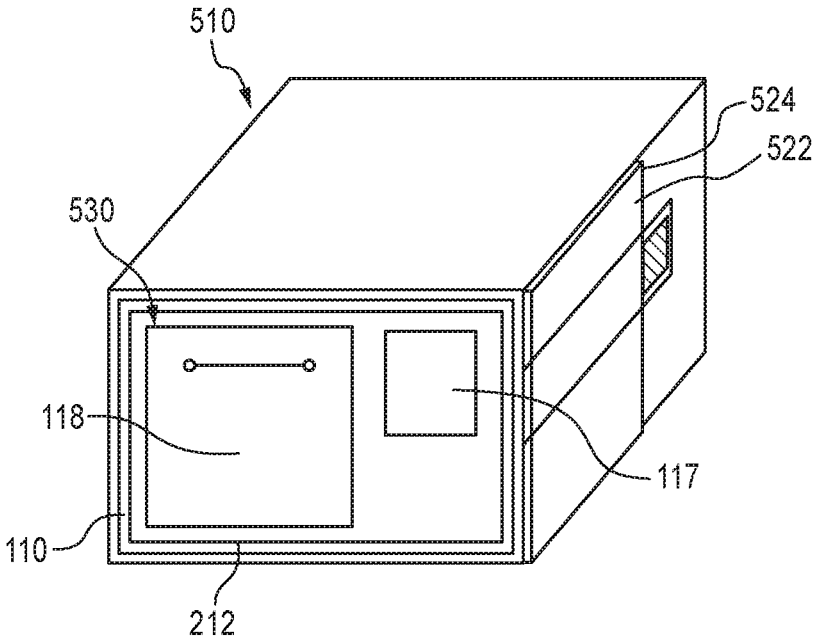
FIG. 5F is a schematic diagram of the system in FIG. 5D, when the doors are in the fully open configuration.

In some embodiment as depicted in FIG. 5D, there may be two doors 522 and 524, forming a front cover 520 to cover the front side of the appliance. A first door 522 and a second door 524 are connected by one or more hinges 526. In FIG. 5E, the first door 522 is pivotable with the one or more hinges 526 so that the first door 522 can fold with the second door 524; the second door 524 is pivotable with one or more hinges fixed on a sliding part slidable along a track, similar to the hinges discussed above. In FIG. 5F, the second door 524 can be pushed to slide backwards with the sliding parts along the track, similar to the door 130 sliding upon the track 240 as discussed above. As the second door slides inwardly upon the track, the first door 522 is urged into the position to be parallel to the track. In some embodiments, the track is long enough so that neither the first door nor the second door forwardly protrudes out of the front side of the appliance. The two doors 522, 524 may have equal width or unequal width. In other embodiments, the first and second doors 522, 524 may be stowed with respect to the appliance (i.e. slid rearwardly along the track) in a folded condition where the faces of the first and second doors 522, 524 are aligned with and face each other.

Figure 6A:
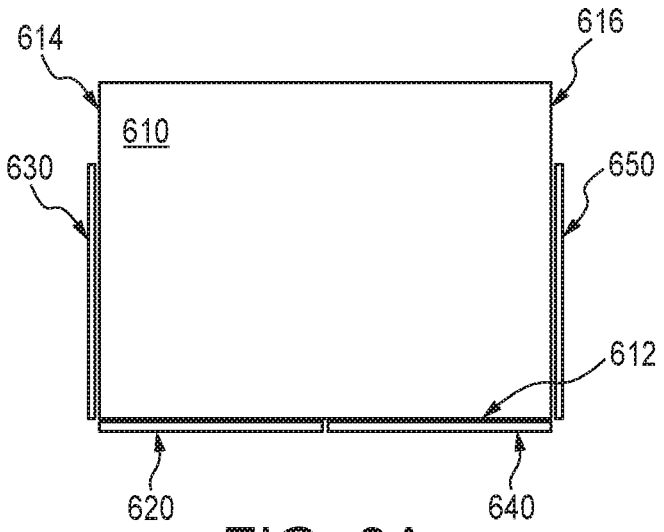
FIG. 6A is a schematic top view of a system in one embodiment with two doors, when the doors are in a fully closed configuration.

In some embodiment in FIG. 6A, two doors are provided, a first door 620 and a second door 640, collectively and selectively covering a front side 612 of an appliance 610. A first track is fixed on a first side 614 of the appliance, and a second track is fixed on a second side 616 of the appliance. Each of the doors 620, 640 may include the structure and functionality as described above with respect to the doors, and tracks and the potential operability of the appliance based upon the position of the doors with respect to their respective tracks.

Figure 6B:
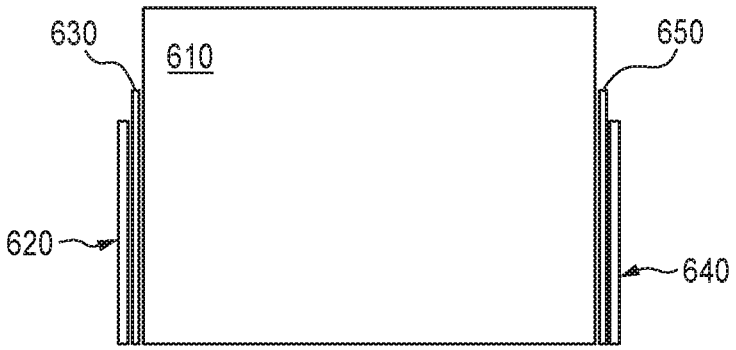
FIG. 6B is a schematic top view of the system in FIG. 6A, when the doors are in a fully open configuration.

As shown in FIG. 6B, when the first door 620 is in the fully open configuration, the first sliding part (similar to 240) is at a fully open position of the first track (similar to 230), and the first sliding part interacts with a door position sensor of a first device (similar to 120). When a second device (similar to 140) detects the appliance is in the working mode, a locking device (similar to 142) of the second device is engaged to block the first sliding part (240) from sliding away from the fully open position of the first track (230).

When the second door 630 is in the fully open configuration, the second sliding part (240) is at a fully open position of the second track (230), and the second sliding part interacts with a door position sensor (120) of a third device. When a fourth device (140) detects the appliance is in the working mode, a locking device (142) of the fourth device is engaged to block the second sliding part (240) from sliding away from the fully open position of the second track (230).

Figure 6C:
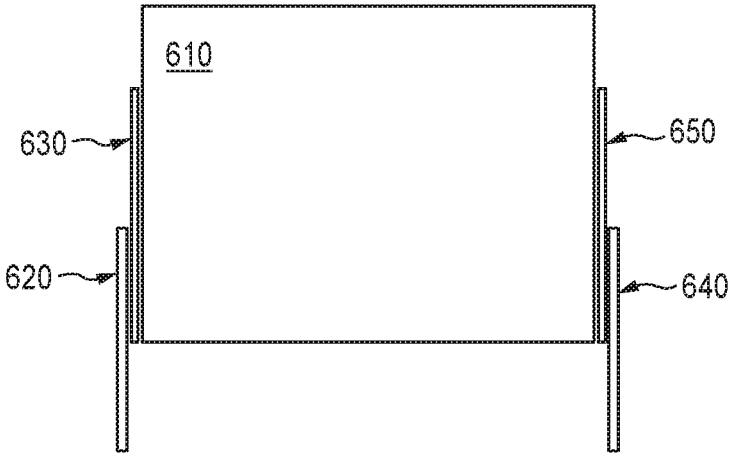
FIG. 6C is a schematic top view of the system in FIG. 6A, when the doors are in a position between the fully closed configuration and the fully open configuration.

As shown in FIG. 6C, the doors 620, 630 are in a position between the fully open configuration and the fully closed configuration.

In some embodiments, the first door 620 and second door 640 may have the same width or different widths, and their corresponding tracks are long enough so that when the doors are in their fully open configuration, the first door and second door do not forwardly protrude out of a front side of the appliance.

Figure 7A:
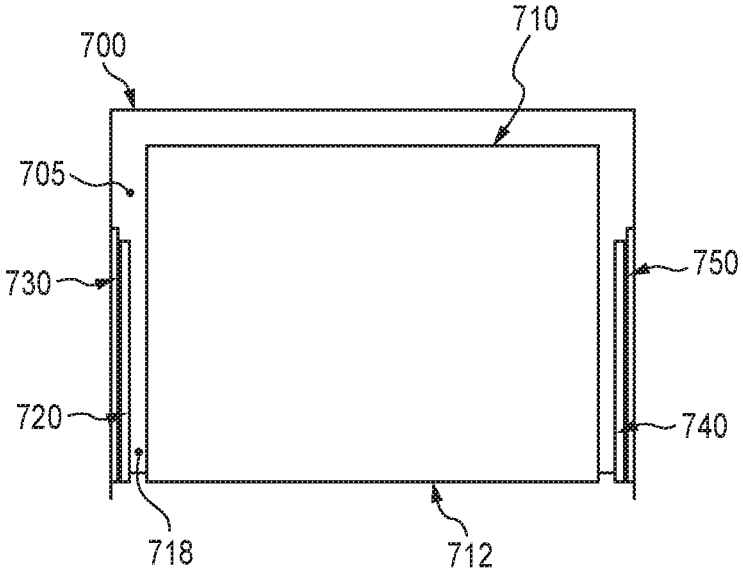
FIG. 7A is a schematic top view of a system in one embodiment with a track fixed on a side wall of an oven compartment, when doors are in a fully open configuration.
Figure 7B:
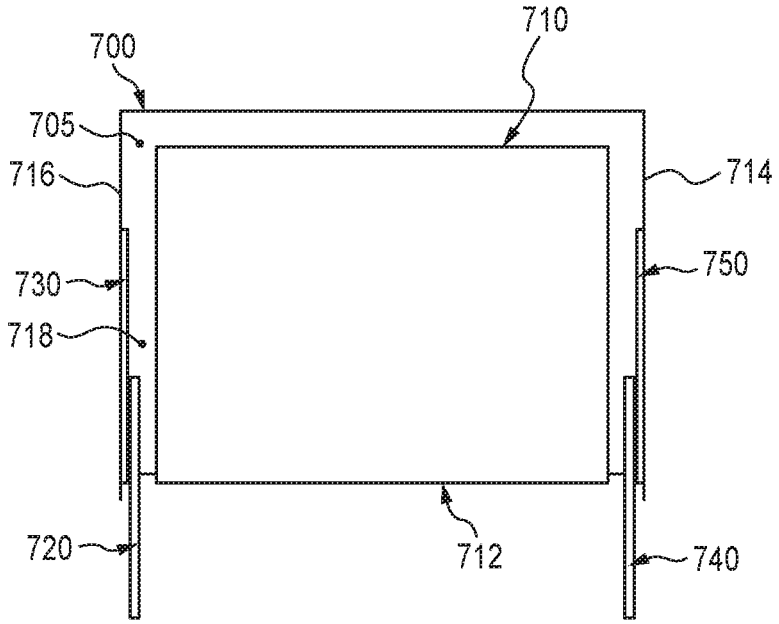
FIG. 7B is a schematic top view of the system in FIG. 7A, when the doors are in a position between the fully closed configuration and the fully open configuration.
Figure 7C:
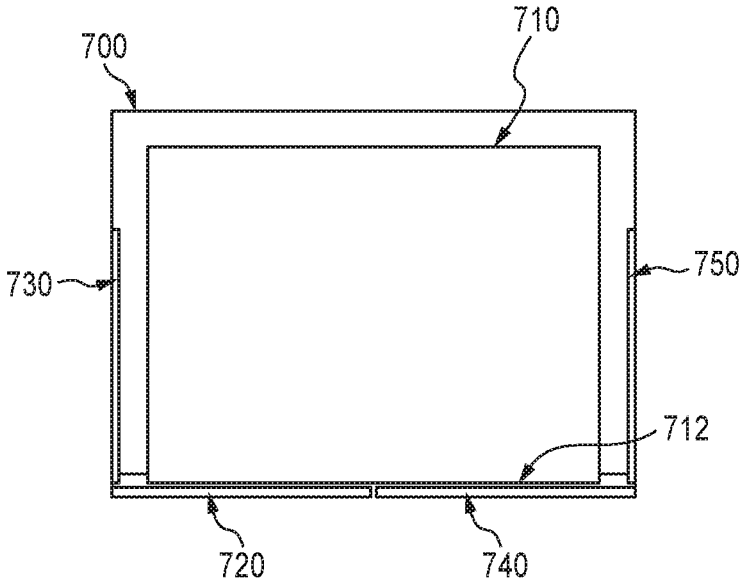
FIG. 7C is a schematic top view of the system in FIG. 7A, when the doors are in the fully closed configuration.

In some embodiments in FIG. 7A, a wall oven 710 (similar to the wall oven 110 discussed above) may sit inside an oven compartment 700. A track 730 (similar to the tracks discussed above) may be fixed on one side wall 714, 716 of the compartment. The side walls 714, 716 may be perpendicular to a front side 712 of the wall oven. A door 720 (similar to one or more of the doors discussed above) is supported by a hinge fixed on a sliding part slidable along the track 730 (similar to the tracks discussed above). In some embodiments, a second door and a second track is on the other side wall of the compartment 700. In some embodiments, the one or more tracks are fixed to the appropriate side walls 714, 716 on the side of the side wall that faces the appliance (such that the doors are within the compartment 700), while in other embodiments, the one or more tracks are fixed to the surface of the respective side walls that face away from the appliance. The doors are in the fully open configuration as depicted in FIG. 7A, in a position between fully open configuration and fully closed configuration as depicted in FIG. 7B, and in the fully closed configuration as depicted in FIG. 7C. In some embodiments, the doors 720 and 740 may have the same width or different widths. In still other embodiments, the door may be mounted to an panel of the oven compartment 700 above the appliance, and the door may pivot downwardly to close the door, and upwardly to allow the door to be opened and stowed. Alternative, the door may be mounted to a panel below the oven compartment, and may be pivot upwardly the close the door and downwardly to allow the door to be opened and stowed.

While the particular disclosure has been described with reference to illustrative embodiments, this description is not meant to be limiting. Various modifications of the illustrative embodiments and additional embodiments of the disclosure will be apparent to one of ordinary skill in the art from this description. Those skilled in the art will readily recognize that these and various other modifications can be made to the exemplary embodiments, illustrated and described herein, without departing from the spirit and scope of the present disclosure. It is therefore contemplated that the appended claims will cover any such modifications and alternate embodiments. Certain proportions within the illustrations may be exaggerated, while other proportions may be minimized. Accordingly, the disclosure and the figures are to be regarded as illustrative rather than restrictive.

The invention claimed is:

1. A system for selectively covering an appliance, the system comprising:

a first device coupled to a door, the first device configured to:

detect whether the door is in a fully open configuration, when it is detected that the door is in the fully open configuration, set an appliance into an operational mode so it is possible for the appliance to operate in a working mode; and when it is detected that the door is not in the fully open configuration, set the appliance into a limited mode where it is not possible for the appliance to operate in the working mode; and a second device comprising a locking device, the second device coupled to the door, the second device configured to:

detect whether the appliance is in the working mode, when it is detected that the appliance is in the working mode, engage the locking device to prevent a motion of the door away from the fully open configuration; and when it is detected that the appliance is not in the working mode, disengage the locking device to allow the motion of the door, and a second door that covers and faces a compartment of the appliance, wherein when the door is not in the fully open position, the second door is positioned between the door and the compartment.

2. The system of claim 1, further comprising:

a track fixed on a side of the appliance;

a sliding part slidable along the track, the sliding part coupled with the first device and the second device; wherein, when the first device detects that the door is in the fully open configuration, the first device detects that the sliding part is at a fully open position along the track; and wherein, when the second device engages the locking device to prevent the motion of the door, the second device engages the locking device to lock the sliding part at the fully open position and to prevent movement of the sliding part away from the fully open position.

3. The system of claim 2, further comprising: a hinge fixed on the sliding part, the hinge configured to receive the door so that: the door is pivotable with a pivoting motion of the hinge, and the door is slidable together with the sliding part along the track.

4. The system of claim 3, wherein: the door is configured to move between a fully closed configuration and the fully open configuration, wherein:

when the door is in the fully closed configuration, the sliding part is at a fully closed sliding position along the track and the door is substantially in parallel with a front face of the appliance so that the door covers a portion of the front face of the appliance; and when the door is in the fully open configuration, the door is substantially in parallel with the side of the appliance so that the door uncovers the front face of the appliance, wherein the front face of the appliance is perpendicular with the side of the appliance.

5. The system of claim 4, wherein: the door is pivotable about 90 degrees with pivoting of the hinge.

6. The system of claim 4, further comprising:

a second track fixed on the side of the appliance, the second track configured to be substantially parallel with the track;

a second sliding part slidable along the second track; and a second hinge fixed on the second sliding part, the second hinge configured to be attached to the door so that: the door is pivotable with a pivoting motion of the second hinge, and the door is slidable with the second sliding part along the second track.

7. The system of claim 6, further comprising:

a third track fixed on a second side of the appliance opposite from the side of the appliance;

a third sliding part slidable along the third track; and a third hinge fixed on the third sliding part, the third hinge configured to be attached to a third door so that:

the third door is pivotable with a pivoting motion of the third hinge, the third door is slidable with the third sliding part along the third track, and the third door is movable between a fully closed configuration and a fully open configuration, where:

when the third door is in the fully closed configuration, the third sliding part is at a fully closed sliding position along the third track, and the third door is substantially in parallel with the front face of the appliance so that the third second door covers a portion of the front face of the appliance; and when the third door is in the fully open configuration, the third sliding part is at a fully open position along the third track, and the third door is substantially in parallel with the second side of the appliance so that the second door uncovers the front face of the appliance.

8. The system of claim 7, further comprising:

a third device coupled to the third door, the third device configured to:

detect whether the third door is in the fully open configuration, when the third device detects that the third door is in the fully open configuration and the first device detects that the door is in the fully open configuration, set the appliance into the operational mode so it is possible for the appliance to operate in the working mode; and when it is detected that the third door is not in the fully open configuration, set the appliance into the limited mode where it is not possible for the appliance to operate in the working mode; and a fourth device comprising a second locking device, the fourth device coupled to the third door, the fourth device configured to:

detect whether the appliance is in the working mode, when it is detected that the appliance is in the working mode, engage the second locking device to prevent a motion of the third door away from the fully open configuration; and when it is detected that the appliance is not in the working mode, disengage the second locking device to allow the motion of the third door.

9. The system of claim 7, wherein: when the door and the third door are both at the fully closed configuration, adjacent edges of the door and the third door are substantially close to each other so that the door and the third door cover substantially the front face of the appliance.

10. The system of claim 1, wherein the first device further comprise: a door position sensor configured to detect that the door is in the fully open configuration; and a controller in communication with the door position sensor, the controller configured to communicate with a control unit of the appliance.

11. The system of claim 10, wherein: the door position sensor comprises at least one of: a push button switch, a toggle switch, a rocker switch, an electrical contact, or a magnet.

12. The system of claim 1, wherein: the locking device comprises a lock comprising a solenoid controlled bar.

13. The system of claim 1, further comprising:

a track fixed on a side wall of a compartment, wherein the appliance is disposed inside the compartment;

a sliding part slidable along the track, the sliding part coupled with the first device and the second device;

wherein, when the first device detects that the door is in the fully open configuration, the first device detects that the sliding part is at a fully open position along the track; and wherein, when the second device engages the locking device to prevent the motion of the door, the second device engages the locking device to lock the sliding part at the fully open position and to prevent movement of the sliding part away from the fully open position.

14. The system of claim 1, wherein: the appliance is disposed in a compartment adjacent to cabinets; and when the door is in a fully closed configuration, the door is aligned with cabinet doors of the cabinets adjacent to the compartment.

15. The system of claim 1, wherein: the appliance is a wall oven.

16. The system of claim 15, wherein: the wall oven is received within an oven compartment.

17. The system of claim 15, wherein, when the wall oven is set into the limited mode, the wall oven is capable at least one of: operating a heating element of the wall oven; turning on a light of the wall oven; operating a timer of the wall oven; communicating with an external device; or operating a fan of the wall oven.

18. The system of claim 1, wherein the appliance is an oven, the second door is an oven door, and the compartment is a cooking compartment.

* * * * *